United States Patent [19]

Youngquist et al.

[11] 3,949,947

[45] Apr. 13, 1976

[54] PAPER DISPENSING DEVICE

[75] Inventors: Robertson Youngquist, Kensington, Md.; Donald Green; Edward Stone Cohen, both of Washington, D.C.

[73] Assignee: New World Container Corporation, Washington, D.C.

[22] Filed: Sept. 23, 1974

[21] Appl. No.: 508,560

[52] U.S. Cl. ..... 242/55.53; 242/138; 225/51

[51] Int. Cl.[2] ..... B65H 19/00

[58] Field of Search ..... 242/55.2, 55.53, 137, 138; 225/46, 51, 52, 53, 79; 206/39.5, 389, 397, 805

[56] References Cited

UNITED STATES PATENTS

| | | | |
|---|---|---|---|
| 765,221 | 7/1904 | Arents, Jr. | 225/52 X |
| 1,739,560 | 12/1929 | Ranck | 225/46 |
| 2,042,947 | 6/1936 | Lewis | 242/137 |
| 2,783,878 | 3/1957 | Traver | 206/389 |
| 2,890,822 | 6/1959 | Lee et al. | 225/51 |

*Primary Examiner*—Leonard D. Christian
*Attorney, Agent, or Firm*—Fleit & Jacobson

[57] ABSTRACT

A dispensing device for a paper web adapted to be carried in a pocket, purse or the like for holding a supply of paper and enabling a desired quantity of such paper to be readily dispensed. The paper may be that type used for rolling your own cigarette, cleaning eyeglass lenses, making notes and the like which are normally difficult to carry without becoming folded, crumpled or otherwise unusable. The dispenser includes a tubular housing receiving a roll of paper including a paper web and core rotatably mounted on a tubular spindle with one end of the paper web extending out through a discharge slot. A resilient band extends through the tubular spindle and biases the roll of paper against the wall of the tubular housing to resist free rotation thereof for controlling the discharge of paper through the discharge slot. The tubular housing also includes an opening for receiving the finger of a person using the device to enable a desired quantity of paper to be discharged by moving the roll of paper away from the interior wall surface of the housing and rotating the roll slightly for circumferential feeding of the end of the paper a short distance out of the discharge slot, where the paper can then be pulled.

10 Claims, 4 Drawing Figures

Fig. 1
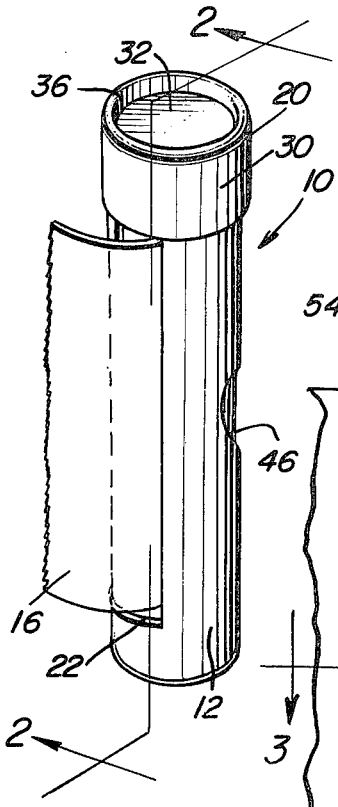
Fig. 2
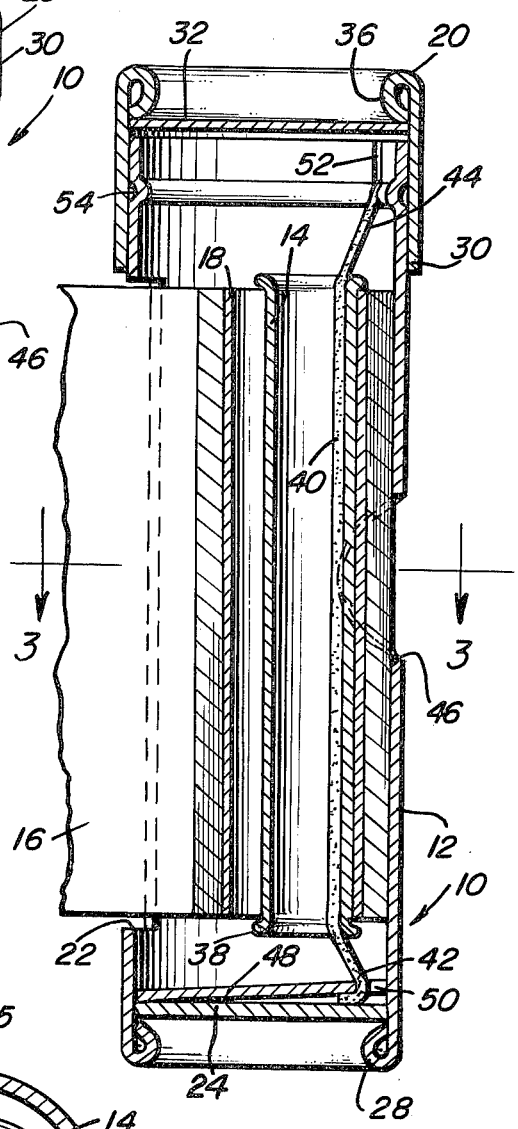
Fig. 4
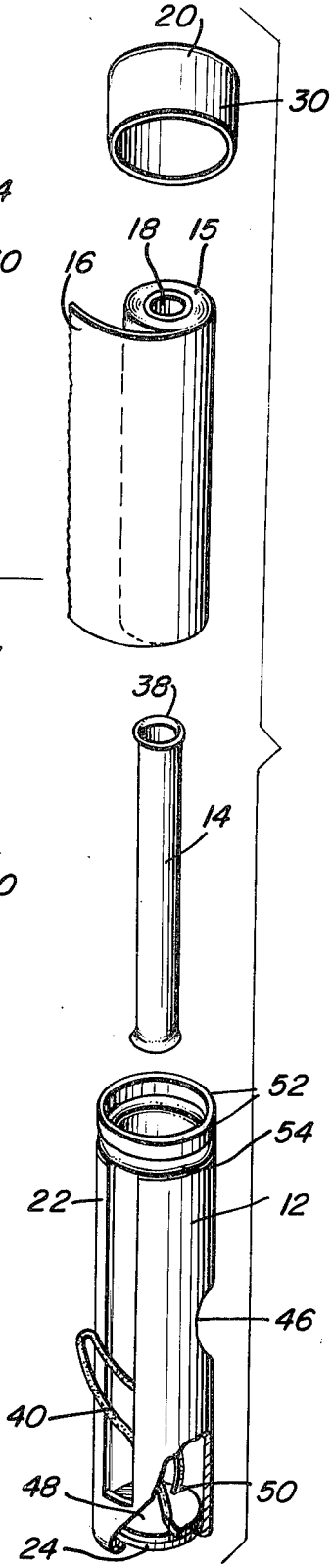
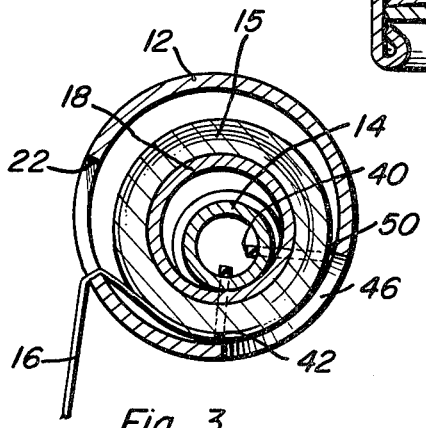
Fig. 3

PAPER DISPENSING DEVICE

BACKGROUND OF THE INVENTION

1. Field of the Invention

The present invention generally relates to a paper dispensing device and more particularly to a relatively small, substantially cylindrical tubular member receiving a roll of paper, such as tissue-like paper, normally carried by a person in a pocket, handbag, purse or the like, and including a discharge slot for the paper, finger-receiving opening to enable the paper to be moved in relation to its housing and a unique resiliently-supported, friction-reducing, tubular spindle receiving the roll of paper for resiliently biasing the tubular spindle to an offset position for frictionally engaging the paper with the inside wall of the housing to prevent free unwinding of the paper from the paper roll.

2. Description of the Prior Art

Small paper members of tissue paper or the like are frequently carried by individuals for various purposes and normally are housed in some type of covering or enclosure for protection. For example, cigarette papers are supplied with a folded cover of heavy paper which affords some protection for the group of cigarette papers, but frequently it occurs that the papers become disarranged within the folder or the folder itself becomes folded, crimped or multilated thus resulting in the cigarette papers becoming difficult if not impossible to use. Papers supplied in this fashion are also a precut size and prevent utilization of papers of varying sizes depending upon the desires of the user.

SUMMARY OF THE INVENTION

An object of the present invention is to provide a paper dispensing device including a tubular housing receiving a roll of paper therein with the roll of paper being mounted on a tubular spindle having a resilient band extending therethrough and associated therewith in a manner that the roll of paper will be biased toward the interior surface of the housing to prevent free unwinding of the paper web from the roll as the paper web is discharged through a discharge slot in the housing.

Another object of the invention is to provide a dispensing device in accordance with the preceding object in which a finger-receiving opening is provided in the housing generally in opposed relation to the discharge slot so that the paper roll may be moved away from the interior surface of the housing towards which it was biased by the resilient band thereby facilitating unwinding of the paper web from the paper roll when it is desired to use a quantity of paper.

Still another object of the invention is to provide a paper dispensing device in which the resilient band is a conventional rubber band and is secured in place at each end of the housing by a notch arrangement in the tubular housing.

Yet another important object of the invention is to provide a paper dispensing device in accordance with the preceding objects which is of relatively small dimensions to facilitate it being carried in a person's pocket, handbag, purse or the like, is made of relatively standard inexpensive components, is effective for protectively supporting a roll of relatively fragile paper, is provided with a removable cap to enable ready assembly of the components for inexpensive and simple manufacture and to enable the paper roll to be changed such as when the paper in the roll has been completely consumed, and otherwise is well adapted for maintaining a supply of paper immediately available to use.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the paper despensing device of the present invention.

FIG. 2 is a vertical sectional view, on an enlarged scale, taken substantially upon a plane passing along section line 2—2 of FIG. 1 illustrating the association of the structural components of the invention.

FIG. 3 is a transverse, sectional view taken substantially upon a plane passing along section line 3—3 of FIG. 2 illustrating further structural details of the device.

FIG. 4 is an exploded, group perspective view of the components of the paper dispensing device illustrating the relationship of the components.

DESCRIPTION OF THE PREFERRED EMBODIMENT

The paper dispensing device of the present invention is generally designated by reference numeral 10 and includes a tubular housing 12, a tubular friction-reducing spindle 14 disposed therein for receiving a roll of paper 15 including a paper web 16 having a core 18 positioned over the spindle 14 and a cap 20 engaged with the housing which, when associated, define generally a cylindrical member of a size adapted to fit conveniently within a person's pocket, handbag, purse or the like.

The tubular housing 12 is of cylindrical construction and may be constructed of various materials such as relatively rigid cardboard or the like. Disposed longitudinally in the wall of the tubular housing 12 is a discharge slot 22 which has a length less than the length of the tubular housing 12 and which has a circumferential extend which is only a small fraction of the circumference of the tubular housing 12 as illustrated in FIGS. 3 and 4. On the other hand the discharge slot is wide enough to permit the easy discharge of the paper therethrough. If desired, the rear longitudinal edge 23 of the discharge slot may be reinforced or treated to prevent wearing which otherwise results from continuous tearing of the paper along this edge. The lower end of the tubular housing 12 is closed by a circular disk 24 secured in place by a reversely folded and crimped flange 28 on the lower end of the tubular housing 12 whereby the closure disk 24 is inset inwardly of the lower end of the housing 12 as illustrated in FIG. 2.

The cap 20 includes a cylindrical circumferential wall 30 provided with a closure disk 32 inset inwardly from the outer end thereof with the closure disk 32 being secured in place by a reversely folded and crimped flange 36 which is integral with the cylindrical wall 30, in the same manner as flange 28 on the lower end of tubular housing 12, thus forming a closure for the tubular housing 12 when the wall 30 is telescoped over the open upper end of the tubular housing 12.

The paper web 16 is spirally wound into a roll of paper 15 having a cylindrical core 18 in the center thereof which may be cardboard or the like with the length of the paper web 16 being determined only by the thickness of the paper and the internal dimensions of the tubular housing 12. The width of the paper web 16 is slightly less than the length of the discharge slot 22 so that the paper web 16 may be easily pulled through the discharge slot 22 or otherwise caused to pass through the slot 22 during rotation of the paper roll within the tubular housing 12. The friction-reducing spindle 14 on which the paper web core 18 is mounted is in the form of a tubular member, constructed of carboard or the like which fits within the core 18 and is slightly longer than the core 18 and is provided with outwardly flared ends 38 as illustrated in FIG. 2. The spindle 14 is free of the tubular housing 12 and can move in relation thereto within the limits of the interior dimensions of the tubular housing 12.

Depending upon the construction material of the spindle, the exterior surface of the spindle 14 is preferably coated with a friction-reducing material, such as aluminum foil or the like, which facilitates the relative rotation of the paper roll on the spindle. It is essential in the construction of the invention that the friction between the inner surface of the paper roll core 18 and the exterior surface of the spindle 14 be kept at a minimum.

The spindle 14 is resiliently retained in proper orientation within the tubular housing 12 by a rubber band 40 which has the major portion of its length extending through the center of the spindle 14 as illustrated in FIG. 2 and the loop end portions 42 and 44 extending laterally to a position adjacent the interior wall surface of the tubular housing 12 so that the resiliency of the rubber band 40 will bias the spindle 14 and the paper roll 15 toward the inner surface of the tubular housing 12 in an area which is spaced circumferentially from the discharge slot 22 so that the paper roll and the paper web 16 on the core 18 will frictionally engage the inner surface of the tubular housing 12 to prevent free rotational movement of the Paper roll within the tubular housing 12. The rubber band 40 is preferably positioned to bias the spindle 14 toward the inner surface of the housing at a position approximately 120° behind discharge slot 22 when looking at the direction from which the paper web 16 is unrolled.

In order to overcome the frictional resistance created by the frictional engagement between the paper roll 15 and the inner surface of the tubular housing 12 and to move the paper roll away from the interior surface of the tubular housing 12, the housing 12 is provided with a finger-receiving hole or aperture 46 in general alignment with the offset ends 42 and 44 of the rubber band 40 (i.e., preferably 120° behind slot 22) so that the paper web, core and spindle can be moved to a centralized position within the housing 12 to enable the circumferential feeding of the end of the paper web 16 a short distance out of the slot 22, where the paper can then readily be pulled, and to enable free rotation of the paper roll during the dispensing of a desired quality of paper from the paper roll.

The lower loop end 42 of the rubber band 40 is secured in place adjacent to closure disk 24 by a retaining disk 48 which has a pair of radial notches 50 at circumferentially spaced points thereon. The radial notches 50 receive the portions of the rubber band 40 that constitute the loop lower end so that the looped lower end of the rubber band extends straight between the inner ends of the notches 50 in underlying relation to this portion of the disk 48 which may be fixedly secured in place after assembly by a suitable adhesive or the like or friction may be relied upon to retain the disk 48 in place. As illustrated, the disk 48 is slightly canted since the portion of the rubber band extending between the inner ends of the notches 50 will elevate one side portion of the disk 48 in relation to the opposite side portion. Thus, the rubber band is permanently attached to the lower end of the tubular housing as illustrated in FIG. 4 with the lower end portion 42 thereof offset or being directed toward the periphery of the tubular housing when assembled. Disk 48 is position such that notches 50 and the lower end portion 42 of the rubber bands are circumferentially arranged in relation to the discharge slot 22 as illustrated in FIG. 3.

For anchoring the upper looped end portion 44 of the rubber band 40 to the tubular housing 12, the tubular housing 12 is provided with a pair of longitudinally extending notches 52 which are circumferentially spaced and which receive the looped upper end of the rubber band with the portion of the rubber band extending between the bottom ends of the notches 52 being disposed exteriorly of the tubular housing 12 and oriented in a peripheral groove 54 in this portion of the tubular housing 12 so that the outer surface of the tubular housing 12 is devoid of projections thereby enabling the cylindrical wall 30 of the cap 20 to closely telescope over the tubular housing 12. Thus, cap 20 retains the upper looped end 44 of the rubber band 40 secured to the periphery of the tubular housing. Similarly, the frictional contact of the looped end 44 of the rubber against the inside surface of the cap wall 30 tends to some extent to hold the cap 20 in place on the tubular housing 12 and thus prevents inadvertent loss of the cap 20.

When it is desired to detach the upper end of the rubber band 40 from the tubular housing 12, the cap 20 is removed and the looped upper end 44 of the rubber band is pulled upwardly out of the notches 52. In this condition, the spindle 14, core and paper web may be removed from the housing and the supply of paper may be replenished by placing a new roll of paper on the spindle and the spindle and assembled paper positioned over the rubber band 40 which is then reattached to the upper end of the tubular housing 12. The rubber band 40 is tensioned when it is attached in its operative position so that it will bias the roll of paper 15, core 18 and spindle 14 laterally toward the inner surface of the tubular housing 12 in the area of the finger-receiving hole 46. Contact between the paper web and the inner surface of the housing 12 will frictionally prevent free rotation of the paper roll thus preventing it from unwinding except when the paper web 16 is pulled or when the paper roll is moved away from contact with the inner surface of the tubular housing 12 which is accomplished by a person inserting his finger through the hole 46 and moving the paper roll 15, core 18 and spindle 14 toward a centered position by stretching or tensioning the rubber band.

While all of the components except for the rubber bands and, of course, the paper web, may be constructed of cardboard, it is pointed out that other materials such as plastic, metal and any combination thereof may be used in constructing the invention. The overall size of the device is such that it can be conveniently carried in a pocket of a user, a handbag, purse or the like and while the device may have many utilities, it is primarily adapted for use in association with paper materials such as cigarette paper, eyeglass lens cleaning paper, tissue paper, facial tissue, note paper and the like. The desired quantity of the paper web is pulled through the discharge slot 22 and the paper web may be torn off by pulling it in a reverse direction toward one edge of the slot 22 such as the lower edge of the slot 22 as observed in FIG. 3. To prevent the paper web 16 from being unwound while it is being torn off, pressure may be exerted on the paper roll by inserting the finger or thumb through the hole 46 and forcing the paper web, core and spindle laterally until it is rigidly engaged with an opposite surface of the interior of the tubular housing 12 in which condition the paper web may be torn off without any more of the web being unwound from the core 18.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

We claim:

1. A dispensing device for flexible material wound into a roll and having a free end, said dispensing device comprising a tubular housing having a peripheral discharge opening, a spindle movable positioned in said housing, a roll of flexible material positioned around the spindle for relative movement with respect to said spindle whereby the free end of the material which is adapted to extend through the discharge opening can be easily unwound, and resilient means acting on said spindle to bias said spindle and roll toward the interior surface of the housing for frictionally resisting movement of the flexible material relative to the housing to prevent free unwinding of the flexible material from the roll.

2. The dispensing device as defined in claim 1 wherein said roll is wound upon a cylindrical core and wherein the frictional relationship between the engaging surfaces of said spindle and said core and the biasing force of the resilient means are such as to assure easy feeding of the free end of the material out through the discharge slot.

3. The dispensing device as defined in claim 1 wherein said tubular housing is elongated and said discharge opening is in the form of a longitudinal slot for passage of flexible material in the form of a paper web, said spindle is adapted to extend through the center of the roll of paper, said housing includes closed ends to prevent longitudinal egress of the spindle and roll of paper with the spindle being free of the housing but retained interiorly thereof and extending substantially throughout the length thereof, and said means interconnecting said housing and spindle for biasing the spindle toward the interior of the housing is disposed at a point spaced circumferentially from the discharge slot.

4. The dispensing device as defined in claim 3 wherein said housing is provided with a finger-receiving opening in circumferentially spaced relation to the discharge slot said resilient means biasing the spindle toward the finger-receiving opening whereby a user may insert his finger through the finger receiving opening and move the paper roll and spindle toward a centralized position in the housing to facilitate unwinding of the paper web from the paper roll on the spindle.

5. The dispensing device as defined in claim 4 wherein said resilient means is in the form of an endless rubber band extending substantially throughout the length of the housing, said spindle being hollow and receiving the major portion of the rubber band, and means securing the ends of the rubber band to the housing in adjacent relation to the periphery thereof in tensioned condition thereby resiliently biasing the spindle laterally toward the inner surface of the housing.

6. The dispensing device as defined in claim 5 wherein one end of the tubular housing is provided with a permanent closure disk, said means securing the resilient band to this end of the tubular housing including a disk having circumferentially spaced radial notches therein extending for distance substantially less than the radius of the disk for receiving the closed end portion of the rubber band, said notched disk being disposed adjacent to the disk permanently mounted in housing.

7. The dispensing device as defined in claim 6 wherein the other end of the housing includes a removable cap having a closure disk therein, said cap including a peripheral wall telescoping over an open end of the housing to enable removal of the spindle and roll of paper to enable the supply thereof to be replenished, the open end of the tubular housing including a pair of circumferentially spaced notches receiving the closed loop end of the rubber band to anchor the end of the rubber band in tensioned condition to the periphery of the housing, the periphery of the housing receiving the rubber band having an externally opening groove therein to receive the rubber band to provide a substantially smooth surface for telescopically receiving the cap whereby the cap also secures the rubber band to the open end of the housing and the rubber band in turn frictionally secures the cap.

8. The dispensing device as defined in claim 7 wherein said housing and cap are of cylindrical construction with the rubber band being sufficiently elongated to enable the paper roll and spindle to be moved laterally sufficiently to be rigidly forced against the interior surface of the housing in opposed relation to the finger-receiving opening to prevent rotation of the paper roll thereby enabling a desired quantity of paper web to be torn from the web wound on the paper roll by pulling the paper in a reverse direction against one edge of the discharge slot.

9. A device for storing and dispensing paper such as cigarette paper, eyeglass lens cleaning paper and the like comprising a generally cylindrical tubular housing dimensioned for convenient reception in a user's pocket, purse or the like, said housing including a closed end and an open end, a removable cap on the open end of the housing, said housing including a longitudinally extending discharge slot in the peripheral wall thereof for receiving the free end of a paper web wound onto a core, a hollow spindle disposed within the housing and positioned within the core of the roll of paper for relative rotation of the core with respect to said spindle, a resilient member extending through the spindle and having its ends attached to the housing adjacent the periphery thereof for resiliently biasing the spindle and paper roll toward the interior surface of the housing for frictionally engaging the paper with the housing to resist unwinding of the paper from the paper roll.

10. The structure as defined in claim 9 wherein said resilient member is in the form of an endless rubber band having loop end portions received in spaced notches formed in offset relation to the center of the housing above and below the spindle to bias the spindle laterally of the housing, said housing including a finger-receiving opening in alignment with the offset ends of the rubber band to enable the finger to be inserted through the opening and move the paper roll and spindle to a centralized position in the housing.

* * * * *